US005601200A

United States Patent [19]

Finkelstein et al.

[11] Patent Number: 5,601,200

[45] Date of Patent: Feb. 11, 1997

[54] CAP LINER FOR HOT FILLED CONTAINER AND METHOD

[75] Inventors: Harvey Finkelstein, Washington Township, N.J.; Victor Flores, Goldens Bridge, N.Y.; Murray Singer, St. Clark, N.J.

[73] Assignee: Tri-Seal International, Inc., Blauvelt, N.Y.

[21] Appl. No.: 755,733

[22] Filed: Sep. 6, 1991

[51] Int. Cl.[6] ..... B65D 53/04

[52] U.S. Cl. ..... 215/348; 215/347; 215/349; 428/66.4; 428/36.5; 428/319.7

[58] Field of Search ..... 428/64, 66, 36.5, 428/319.7; 215/347, 348, 349

[56] References Cited

U.S. PATENT DOCUMENTS

| | | | |
|---|---|---|---|
| 3,595,419 | 9/1969 | Dukess | 215/329 |
| 3,819,460 | 6/1974 | Dukess | 428/64 |
| 3,917,100 | 11/1975 | Dukess | 215/329 |
| 3,963,845 | 6/1976 | Dukess | 428/64 |
| 3,976,217 | 8/1976 | Dukess . | |
| 4,057,159 | 11/1977 | Fillmore et al. | 215/222 |
| 4,089,434 | 5/1978 | Tagalakis et al. | 215/260 |
| 4,107,247 | 8/1978 | Dukess | 264/45.9 |
| 4,121,728 | 10/1978 | Tagalakis et al. | 215/260 |
| 4,206,165 | 6/1980 | Dukess | 264/45.9 |
| 4,734,312 | 3/1988 | Sugiyama | 428/157 |
| 4,807,772 | 2/1989 | Schloss | 215/349 |
| 4,810,570 | 3/1989 | Rutien et al. | 428/318.6 |
| 4,818,577 | 4/1989 | Ou-Yang | 428/36.5 |
| 4,911,978 | 3/1990 | Tsubone et al. | 428/317.6 |
| 4,935,273 | 6/1990 | Ou-Yang | 428/35.7 |
| 4,937,139 | 6/1990 | Genske et al. . | |
| 5,000,992 | 3/1991 | Kelch | 428/36.5 |
| 5,079,057 | 1/1992 | Heider | 428/36.5 |

FOREIGN PATENT DOCUMENTS

| | | |
|---|---|---|
| 0205914A1 | 12/1986 | European Pat. Off. . |
| 0227421A1 | 7/1987 | European Pat. Off. . |
| 0329490A3 | 8/1989 | European Pat. Off. . |

*Primary Examiner*—James J. Seidleck
*Assistant Examiner*—Michael A. Williamson
*Attorney, Agent, or Firm*—Lowe, Price, LeBlanc & Becker

[57] ABSTRACT

A cap liner and method for producing a cap liner which is particularly suited for use with a cap employed on a hot filled container. The liner includes a disc having one or more outer layers and an intermediate foamed layer bonded thereto. Preferably, the outer and intermediate layers are formed of homogenous admixtures of polypropylene and polyethylene. The method for producing the cap liner involves mechanically mixing at room temperature polypropylene and polyethylene to form a desired homogenous admixture for each layer, and then co-extruding the admixtures at approximately 320°–390° F. to form the bonded outer and intermediate layers. Alternatively, the intermediate layer may be formed of foamed polyethylene.

7 Claims, 1 Drawing Sheet

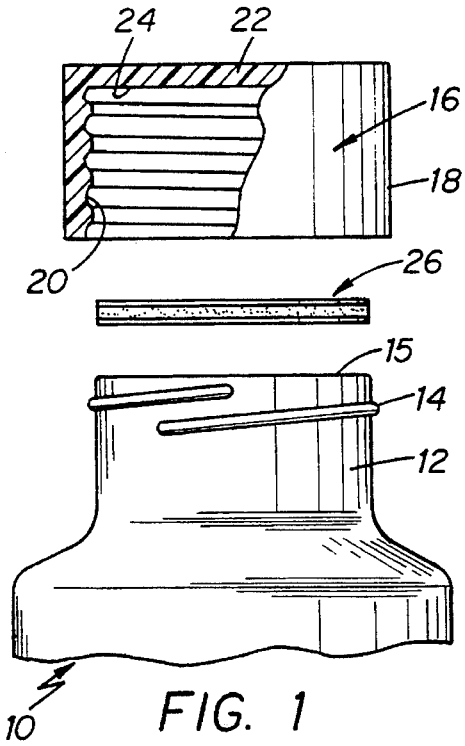
FIG. 1
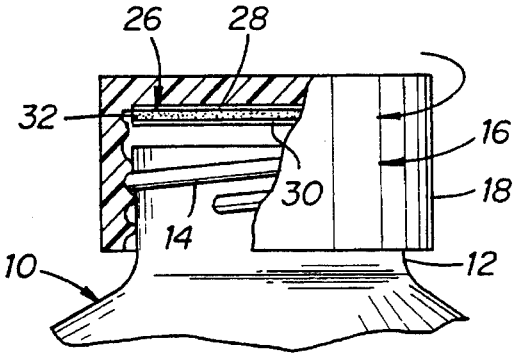
FIG. 2
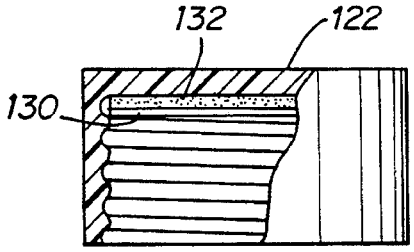
FIG. 6
FIG. 3
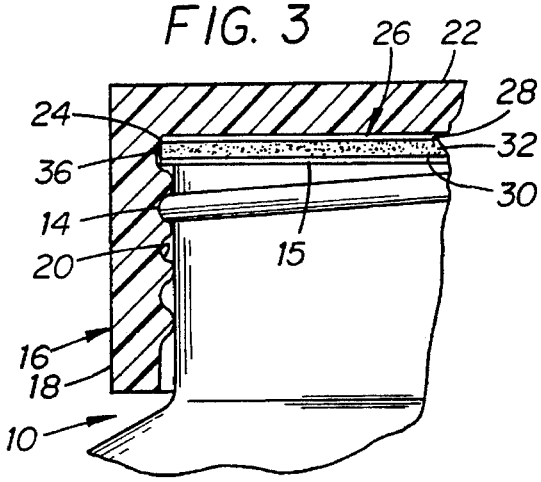
FIG. 4
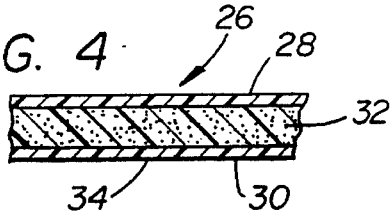
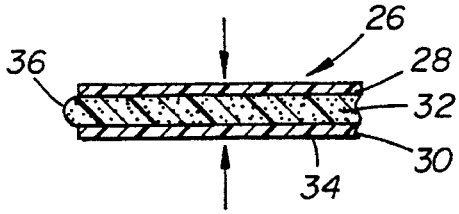
FIG. 5
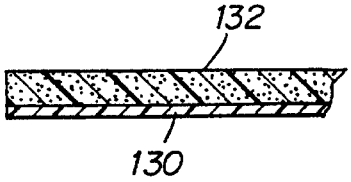
FIG. 7

CAP LINER FOR HOT FILLED CONTAINER AND METHOD

BACKGROUND

The present invention relates to a cap liner and method for producing a cap liner which is particularly suited for use with a cap employed on a hot filled container.

To minimize the potential for contamination, many food products and the like are packaged in containers at very high temperatures. After the heated product is put in the container, a cap preferably having a sealing liner positioned therein is used to seal the contents of the container to prevent leaking between the threaded portions of the container neck and the cap by providing a positive seal at the mouth of the container. As a result, the cap liner is often subjected to the high heat from the contained product until sufficient time elapses for the product to cool. Therefore, a need has been created for an economical cap liner which provides an effective seal for a hot filled container and does not physically or functionally degrade when exposed to heat. The cap liner and method of the present invention meet this need.

BRIEF DESCRIPTION OF THE PRIOR ART

Various cap liners and methods of producing cap liners are known in the patented prior art as evidenced by the patents to Dukess U.S. Pat. Nos. 4,107,247, 3,819,460, 3,595,419 and 3,976,217.

Such liners have been provided as a multilayer sandwich having one or more solid low density polyethylene outer layers and a flexible and resilient foamed inner or intermediate layer of a rubber-like material such as polyethylene, ethylene vinyl acetate, or the like. Cap liners of this type have been manufactured by way of simultaneous multiple extrusion using a combination dye for bonding the layers together.

An important feature of these cap liners is that the inner or intermediate layer expands outwardly beyond the outer layer or layers upon compression between the container and the cap, thereby abutting against the side walls of the cap to produce an effective seal. Such cap liners also have the advantages of being stress and crack resistant, bendable, compressible, and impervious to moisture, chemicals and acids when formed of appropriate materials.

Although known cap liners have proved to be economical and effective for sealing containers when not exposed to heat, such liners melt and/or weaken when used with caps on hot filled containers, thereby decreasing the effectiveness of the seal. Materials such as polypropylene are strong and heat resistant and thus would be useful in cap liners for hot filled containers. Up to the present time, however, it has not been possible to bond a polypropylene layer to another layer or layers formed of polyethylene in multilayer cap liners. Also, it has been difficult to foam polypropylene so that it could be used for the intermediate foamed layer in such cap liners. As a result of these problems, polypropylene has not been used in such cap liners.

SUMMARY OF THE INVENTION

Accordingly, it is a primary object of the present invention to provide a cap liner having all of the advantages of the prior cap liners, but which does not structurally or functionally degrade when exposed to heat from hot filled containers.

Another object of the invention resides in the production of a low cost cap liner which is capable of being co-extruded as a multilayer sandwich.

According to a more particular object of the invention, the liner comprises an intermediate layer and one or more outer layers bonded thereto, the outer solid layers and/or the intermediate foamed layer including polypropylene and polyethylene which are bonded together in a unique manner.

Another object of the invention is to provide a method for manufacturing a heat resistant cap liner having a flexible and resilient intermediate foam layer and one or more outer solid layers wherein at least one layer is formed by mechanically mixing at room temperature polypropylene and polyethylene to form a homogeneous admixture, and extruding the admixture at approximately 320°–390° F.

More particularly, the method includes the step of simultaneously extruding one or more outer layers with the intermediate foam layer for bonding thereto.

DESCRIPTION OF THE DRAWING

Other objects and advantages of the subject invention will become apparent from a study of the following specification when viewed in light of the accompanying drawing, in which:

FIG. 1 is an exploded, elevational view, with parts in sections illustrating the cap and liner therefor made from liner material according to the invention;

FIG. 2 is an elevational view like FIG. 1, showing the cap liner therefor in a stage of being secured on the neck of a container;

FIG. 3 is an enlarged elevational view, with parts in section and parts broken away, illustrating a portion of the cap and liner therefor as firmly secured on a container;

FIG. 4 is a partial sectional view of the liner material;

FIG. 5 is a view similar to FIG. 4 but showing the shape of the liner after it has been compressed when the cap has been tightly closed on the container;

FIG. 6 is an elevational view of a modification of the cap liner; and

FIG. 7 is a sectional view of the modified liner shown in FIG. 6.

DETAILED DESCRIPTION

With continuing reference to the accompanying drawing, wherein like reference materials designate similar parts throughout the various views, reference numeral 10 is used to generally designate a conventional container such as a bottle, tube or can having a neck 12 which is threaded at 14. In order to provide a closure for the container 10, a cap 16 is employed which includes cylindrical side walls 18 which are internally threaded at 20 and a top 22. A cylindrical groove 24 is formed as the uppermost of the threads 20 and is for the purpose of receiving therein a liner 26. The cap 16 is preferably molded out of any suitable synthetic plastic material and is adapted to be threadably secured on the neck 12 with the threads 20 engaging the threads 14.

As shown in FIG. 4, a liner 26 formed in accordance with the invention, comprises a sandwich of outer layers 28 and 30, and an intermediate layer 32. The liner preferably is stamped in the shape of a disc.

The outer layers 28 and 30 comprise polypropylene, thereby providing a stress resistant, crack resistant, relatively non-resilient, impervious layer which does not melt or weaken when exposed to heat. More specifically, the outer layers 28 and 30 are an admixture of polypropylene and poly-ethylene, thereby enabling increased bonding strength with an intermediate layer 32 comprising polyethylene while still being unaffected by heat from hot filled containers. It has been found that the preferred admixture for the outer layers 28 and 30 is approximately 10–98% of polypropylene and the remainder of polyethylene. Depending on the composition of the intermediate layer 32, the amount of polyethylene in the outer layers 28 and 30 can be increased or decreased to enhance the bonding strength with the intermediate layer 32.

The intermediate layer 32 preferably is a resilient homogeneous foamed admixture of polypropylene and polyethylene, thereby providing a flexible and resilient, compressible layer which does not melt or weaken when exposed to heat. To obtain the desired properties, the intermediate layer 32 should be an admixture of approximately 20–80% of polypropylene and the remainder of polyethylene. It has been found that the preferred admixture is approximately 60% polypropylene and 40% polyethylene.

Previously polypropylene has not been considered to be a viable material for use in a foamed layer such as the intermediate layer 32 because it has proven to be difficult to foam. The novel admixture and method of the present invention have solved this problem.

It is noted that for certain applications, the intermediate layer may be formed of foamed polyethylene when the outer layer or layers is an admixture of polypropylene and polyethylene to provide strength and heat resistance.

In accordance with the invention, a method for effectively and economically manufacturing a cap liner with one or more layers containing polypropylene has been provided. In accordance with the method, polypropylene and polyethylene granules are mechanically mixed together, preferably at room temperature in a tumbler or the like to form a homogeneous admixture. For the foam layer, approximately 1.5% of foam concentrate is added to the admixture to enhance the foaming process. The admixture is then extruded at approximately 320°–390° F., thereby forming a foamed or solid homogeneous layer which has superior mechanical strength and does not melt or weaken when exposed to heat. Although polypropylene is difficult to foam, the polyethylene apparently works as a catalyst to promote foaming. The polypropylene molecules become entrapped in the layer by the bonding of the polyethylene molecules acting as nucleating agents.

Preferably, outer skin layers 28 and 30 are simultaneously extruded with the intermediate layer 32 for bonding thereto to form a multilayer sandwich. The outer layers 28 and 30 are an admixture of polypropylene and polyethylene as hereinbefore described. The various layers are brought together with a combination dye at about 320° to 390° F. for bonding within the combination dye. Because of the presence of polyethylene in both the intermediate and outer layers, with polypropylene entrapped within the polyethylene in at least the outer layer or layers, the bonding of these layers is enhanced, thereby overcoming the problem of attempting to bond a pure polyethylene layer to a pure polypropylene layer during co-extrusion. The resultant sheet material can then be stamped into desired liner shapes and sizes.

When the disc 26 is inserted in the groove 24 in a normal state it will freely rotate therein permitting for effective setting of the disc 26 within the groove 24 and effective engagement of the mouth 15 of the container 10 against the under surface 34 of the adjacent outer layer 30. Continued closure of the cap 16 causes the resilient intermediate layer 32 to be compressed to produce a tongue 36 extending beyond the peripheral edges of the outer layers 28 and 30, as shown in FIG. 3, into engagement with the inner wall of the groove 24 to provide an effective seal between the liner 26 and the cap 16. Thus, there is achieved an inner effective seal for the contents of the container 10 which does not structurally or functionally degrade when used with hot filled containers, and the cap liner 26 has superior mechanical strength while still retaining all of the desirable features of the prior cap liners.

In FIGS. 6 and 7 there is shown a modified form of the invention wherein a two-ply liner is used. The cap has its top 122 serving as the upper outer layer, there being only an intermediate liner layer 132 and a lower or outer liner layer 130.

While in accordance with the patent statute the preferred forms and embodiments of the invention have been illustrated and described, it will be apparent to those of ordinary skill in the art that various changes and modifications may be made without deviating from the inventive concepts set forth above.

What is claimed is:

1. A cap liner in the form of a disk having an intermediate layer for positioning against the inside of the cap and a lower outer layer bonded to said intermediate layer, said intermediate layer comprising a resilient foamed homogenous admixture of polyethylene and 10–98% of polypropylene, and said outer layer comprising a substantially homogenous admixture of polyethylene and 10–98% of polypropylene.

2. A cap liner as defined in claim 1, wherein said intermediate layer admixture is approximately 10–80% of polypropylene homopolymer and the remainder of low density polyethylene.

3. A cap liner as defined in claim 2, wherein said intermediate layer admixture is approximately 60% of polypropylene and 40% of polyethylene.

4. Closure liner for a container having a neck portion and a rim portion which defines a container opening, said closure liner comprising a cap which is operable to be received on the neck portion, a cap liner positioned inside said cap comprising a disk having a pair of outer layers and an intermediate layer sandwiched between said outer layers and co-extruded thereto, said outer layers comprising a substantially homogenous admixture of polyethylene and 10–98% of polypropylene, and said intermediate layer comprising a resilient foamed admixture of polyethylene and polypropylene, said liner being positioned in said cap such that when said cap is positioned on the neck portion one of said outer layers is positioned against an inside top portion of said cap, the other outer layer engages the container rim portion and covers the opening, and said intermediate layer is compressed to provide an effective seal between said cap liner and the container which does not structurally or functionally degrade when exposed to heat from a hot filled container.

5. A closure liner as defined in claim 4, wherein said outer layer admixture is approximately 10–80% of polypropylene and the remainder of polyethylene.

6. A closure liner as defined in claim 4, wherein said intermediate layer admixture is approximately 20–80% of polypropylene and the remainder of polyethylene.

7. A closure liner as defined in claim 6, wherein said intermediate layer admixture is approximately 60% of polypropylene and 40% of polyethylene.

* * * * *